US007644570B2

(12) United States Patent
Lassmann

(10) Patent No.: US 7,644,570 B2
(45) Date of Patent: Jan. 12, 2010

(54) METHOD FOR OPERATING AN OPEN-END SPINNING DEVICE

(75) Inventor: Manfred Lassmann, Nettetal (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 77 days.

(21) Appl. No.: 11/988,841

(22) PCT Filed: May 18, 2006

(86) PCT No.: PCT/EP2006/004711

§ 371 (c)(1),
(2), (4) Date: Jan. 15, 2008

(87) PCT Pub. No.: WO2007/009525

PCT Pub. Date: Jan. 25, 2007

(65) Prior Publication Data

US 2009/0120052 A1 May 14, 2009

(30) Foreign Application Priority Data

Jul. 19, 2005 (DE) ..... 10 2005 033 562

(51) Int. Cl.
*D01H 4/50* (2006.01)

(52) U.S. Cl. ..... 57/263; 57/264; 57/404

(58) Field of Classification Search ..... 57/263, 57/264, 265, 404
See application file for complete search history.

(56) References Cited

U.S. PATENT DOCUMENTS 4,712,367 A * 12/1987 Lassmann ..... 57/263
4,825,632 A * 5/1989 Raasch et al. ..... 57/264
5,419,111 A 5/1995 Wassenhoven et al. ..... 57/407
5,509,261 A * 4/1996 Wassenhoven et al. ..... 57/263
5,850,730 A 12/1998 Wassenhoven et al. ..... 57/408
6,035,622 A 3/2000 Fox et al. ..... 57/263
6,339,921 B1 * 1/2002 Lassmann et al. ..... 57/264
6,606,847 B2 * 8/2003 Ludvicek et al. ..... 57/263

FOREIGN PATENT DOCUMENTS

DE 40 30 100 A1 4/1992
DE 196 50 597 A1 6/1998
DE 103 38 842 A1 3/2005

OTHER PUBLICATIONS

Raasch H. et al. "Automatisches Anspinnen Beim OE-Rotorspinnen" Melliand Textilberichte, International Textile Reports, Melliand Textilberichte, Frankfurt Am Main, DE, vol. 70, No. 4, Apr. 1, 1989, pp. 251-256 XP000099924 ISSN: 0341-0781.

* cited by examiner

*Primary Examiner*—Shaun R Hurley
(74) *Attorney, Agent, or Firm*—K&L Gates LLP

(57) ABSTRACT

The invention relates to a method for operating an open-end spinning device (1), comprising a spinning rotor (2) and an opening roller (12), which can be controlled so as to be driven individually independently of one another, wherein after an interruption in the spinning process takes place as a result of the detection of the absence of a thread, a piecing operation is initiated, comprising a piecing process, in which an upper thread passes through a fiber ring formed in the spinning rotor (2) and is connected to the latter, and a subsequent drawing-in accumulating process which serves to reduce a thin point in the thread following the piecer, wherein during the piercing operation, the opening roller (12) is temporarily driven at a piecing speed which is higher than the operating speed of the opening roller (12).

5 Claims, 2 Drawing Sheets

METHOD FOR OPERATING AN OPEN-END SPINNING DEVICE

CROSS-REFERENCES TO RELATED APPLICATIONS

This application claims the benefit of German patent application DE 10 2005 033 562.4, filed Jul. 19, 2005, herein incorporated by reference.

BACKGROUND OF THE INVENTION

The present invention relates to a method for operating an open end spinning device comprising a spinning rotor and an opening roller, which can be driven individually, and controlled independently of one another. More particularly, the invention relates to such a method wherein, after an interruption of the spinning process has taken place as a result of the detection of the absence of a thread, a piecing process is introduced, in which an upper thread passes through a fiber ring formed in the spinning rotor and is connected thereto, as well as a subsequent drawing in accumulation, which is used to reduce a thin point in the thread following the piecing.

With increasing requirements of the yarn production process, higher and higher demands are also being made on the production of piecings. The process for forming piecings after thread interruptions, the piecing, is generally carried out at the individual spinning stations of the open end rotor spinning machines by a piecing mechanism travelling along the spinning machine, the so-called piecing carriage.

After a thread break, for example, which triggers the piecing, it takes different lengths of time as a function of the position of the piecing carriage at the open end rotor spinning machine until spinning can start again at the relevant spinning station. During the thread break, the drawing in of the fiber is switched off, but the opening roller, which continues to run, still releases fibers at this time from the tuft. In order to achieve the same conditions during piecing and therefore as far as possible the same prefeed quantity of fibers, the tuft is leveled before each piecing.

The actual process of piecing begins with the start of the spinning rotor. In the time after the tuft levelling of the fiber band presented until the drawing in for the operational fiber feed is switched on, fibers are in turn combed out from the tuft of the fiber band and sucked off via the rotor edge of the stationary spinning rotor.

In addition to the after-running of the fiber flow after switching off the drawing in and the delayed start-up after switching on the drawing in, the fiber flow may also react with a delay on increasing the drawing in speed. This can lead to the thread becoming too thin during the run-up of the spinning rotor. This occurs to a particularly marked extent at low drawing in speeds. To avoid this undesired thickness deviation, a drawing in accumulation process can be carried out. Drawing in accumulation processes of this type during piecing are described in detail, for example, in DE 40 30 100 A1 or in the publication by Raasch et al "Automatisches Anspinnen beim OE-Rotorspinnen", Melliand Textilberichte April 1989, pages 251 to 256.

A single motor-driven opening roller for an open end spinning device is known from German Patent Publication DE 103 38 842 A1. The opening roller known from this document is used on the open end spinning device in the manner already described in the prior art mentioned above.

It has proven to be disadvantageous that the delay described at the outset also occurs here when providing the required fiber quantity for piecing that is necessary for the drawing in accumulation. However, it is important for the quality of the piecings that the fiber supply takes place in a reproducible manner and without a delay.

SUMMARY OF THE INVENTION

It is therefore the object of the present invention to provide a method, by means of which the uniformity of the yarn during the spinning process is improved.

This object is achieved according to the invention by providing a method for operating an open end spinning device, comprising a spinning rotor and an opening roller, which can be driven individually, and controlled independently of one another. After an interruption of the spinning process has taken place as a result of the detection of the absence of a thread, a piecing process is introduced, in which an upper thread passes through a fiber ring formed in the spinning rotor and is connected thereto, as well as a subsequent drawing in accumulation, which is used to reduce a thin point in the thread following the piecing. According to the present invention, during the piecing process, the opening roller is temporarily driven at a piecing speed, which is above the operating speed of the opening roller.

Advantageous configurations of the invention are described more fully hereinafter.

According to the invention, it is provided that, during the piecing process, the opening roller is driven at a piecing speed, which is above the operating speed of the opening roller. After the process of tuft levelling, which is used to create the same conditions during piecing, always displaced by the same time span with respect to this process, a quantity of fiber band is drawn in so as to provide substantially the same fiber quantity at the beginning of the piecing process. The higher piecing speed compared to the operating speed of the opening roller brings about a higher fiber throughput, so after the build up of the fiber ring during the piecing process in the spinning rotor a fiber quantity is provided for piecing such that after the working off of the fiber ring, no lack of fiber due to a delay occurs causing a thin point. The higher piecing speed of the opening roller moreover achieves a more effective combing out of the fibers, which additionally leads to an improvement in the piecing behaviour.

The piecing speed of the opening roller should preferably be reached before the beginning of the piecing process. The reproducibility of the fiber supply required for the quality of the piecings is thus achieved. Since the fibers are constantly combed out at the same piecing speed of the opening roller, the same fiber quantity is constantly supplied to the spinning rotor during piecing.

In particular, the piecing speed of the opening roller can be maintained during the complete working off of the drawing in accumulation. In this manner, the increased fiber throughput is also kept constant beyond the conclusion of the actual piecing up process so as to avoid, as desired, a thin point adjoining the piecing. Following the drawing in accumulation process, the spinning speed of the opening roller is reduced to the operating speed adapted to the normal spinning operation. This is used to ensure the yarn uniformity of the thread to be spun. The open end spinning device can thus be operated according to the invention at an opening roller speed optimally adapted to these processes both for the piecing process and for the spinning operation.

The speed control of the opening roller during the piecing process and the process of the drawing in accumulation can advantageously take place independently of other parameters influencing these processes by means of a control mechanism. This is achieved by the use of single motor drives, for example for the spinning rotor and the opening roller, which are in each case connected via signal lines to the control mechanism and are controlled by the latter independently of one another.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENT

Figure 1:
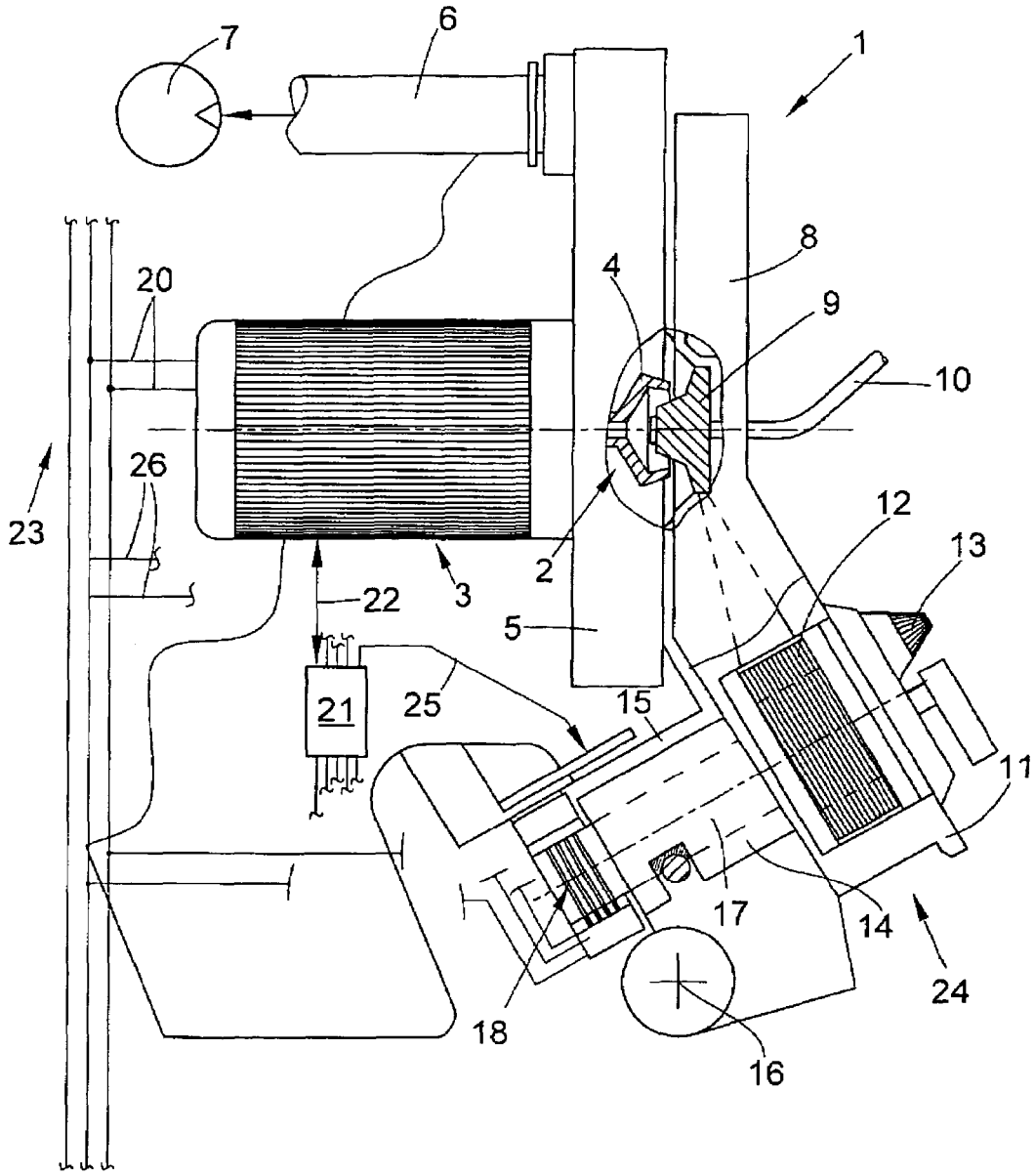
FIG. 1 shows an open end rotor spinning device with single motor drives at least for the spinning rotor, opening roller and a control mechanism for these drives.

The view in FIG. 1 shows an open end spinning device 1 of an open end rotor spinning machine, which is arranged in the region of the spinning stations of textile machines of this type. Open end spinning devices 1 of this type are known in principle and described in relative detail, for example, in German Patent Publication DE 196 50 597 A1.

The open end spinning device 1 comprises a spinning rotor 2 with a rotor cup 4, which revolves during spinning operation at a high speed in a spinning rotor housing 5 which is acted on by a reduced pressure. The rotor housing 5, which is closed at the front by a cover element 8 during spinning operation, is connected for this purpose via a pneumatic line 6 to a reduced pressure source 7, which provides the reduced pressure in the rotor housing 5 necessary for spinning.

The spinning rotor 2 can be driven in a defined manner by a controllable electric motor single drive 3, which is connected via electric lines 20 to the energy supply 23 of the relevant textile machine. The electric motor single drive 3 is connected for this purpose to a control mechanism 21 via at least one signal line 22.

The cover element 8, which closes the rotor housing 5 during the spinning operation, is mounted so as to be rotatable to a limited extent about a pivot pin 16, so the stationary spinning rotor 4 is accessible if necessary. A so-called channel plate adapter 9 is also let into the cover element 8, so as to be replaceable, at the level of the spinning rotor 2 and is adjoined by a thread draw-off tube 10. Furthermore, the cover element 8 has an opening roller housing 11, in which an opening roller 12 rotates and is fixed by its bearing shaft 17 in a rear bearing bracket 14 of the opening roller housing 11.

The opening roller 12 is driven by an electric motor single drive 24, which is configured as an external rotor, and for easy detachable coupling to the energy supply 23 of the open end rotor spinning machine has a contact track mechanism 18 at the end region of its bearing shaft 17. The electric motor single drive 24 is also connected via a signal line to the control mechanism 21 and can be controlled thereby.

A fiber band draw-in cylinder 13 is also rotatably mounted in the opening roller housing 11 and can be acted upon by an electric motor by means of a drive 15, preferably a stepping motor. The drive 15 is also connected by an electric line 26 to the energy supply 23 of the textile machine and by a signal line 25 to the control mechanism 21.

Once an interruption of the spinning process has occurred because of the detection of the absence of a thread by means of a thread monitoring device, not shown, the spinning device 1 is firstly shut down. A piecing process for thread connection is then initiated. The piecing process begins with the tuft levelling to provide the same preconditions for the piecing process, regardless of how long the shut down of the spinning device 1 lasts. Following the tuft levelling, the spinning rotor 2, which has a speed of about 120,000 $min^{-1}$ or more during spinning operation, is initially run up in such a way that the spinning rotor 2 has a minimum speed required for the successful carrying out of the piecing process, which depends in particular on the design and operating speed of the respective spinning rotor 2. The single motor drive 3 of the spinning rotor 2 is controlled for this purpose by the control mechanism 21.

At this instant of the piecing process, regardless of the run-up of the spinning rotor 2, the electric motor drive 24 of the opening roller 12 is also controlled by the control mechanism 23 in such a way that it has a piecing speed that is independent of the minimum speed of the spinning rotor 2, which is above the operating speed. The piecing speed is preferably between 10% and 40% above the operating speed of the opening roller 11 during spinning operation.

The piecing speed is achieved prior to the beginning of the piecing process. With the beginning of the piecing process, the fiber band is more intensively combed out by the opening roller 12 rotating at the higher piecing speed, and the conveying speed is increased, compared to that which is the case during normal spinning operation at the operating speed of the opening roller 12. Thus a higher fiber throughput is achieved during the prefeed. The build up of the fiber ring in the spinning rotor 2 accordingly takes place more quickly. On conclusion of the prefeed, the fiber supply is interrupted.

The thread end prepared for piecing is now introduced by the draw-off tube 10 into the rotating spinning rotor 2, in which it meets the fiber ring previously built up in the spinning rotor 2. The thread end passes through the fiber ring and is connected to the fibers which are deposited on the thread end, so the piecing is created.

The process of the drawing in accumulation following the piecing up of the thread on the fiber ring is used to compensate the delay of the fiber supply occurring between the prefeed for piecing and the restarting of the fiber supply. A delay of the fiber supply means that the thread, during the run-up of the spinning rotor 2, has irregularities in the form of a thin point, which occur directly after the piecing and influence the quality of the thread in a lasting manner. Over the time period for carrying out the piecing and the drawing in accumulation process, the speed of the spinning rotor 2 increases uniformly until the operating speed is reached.

Figure 2:
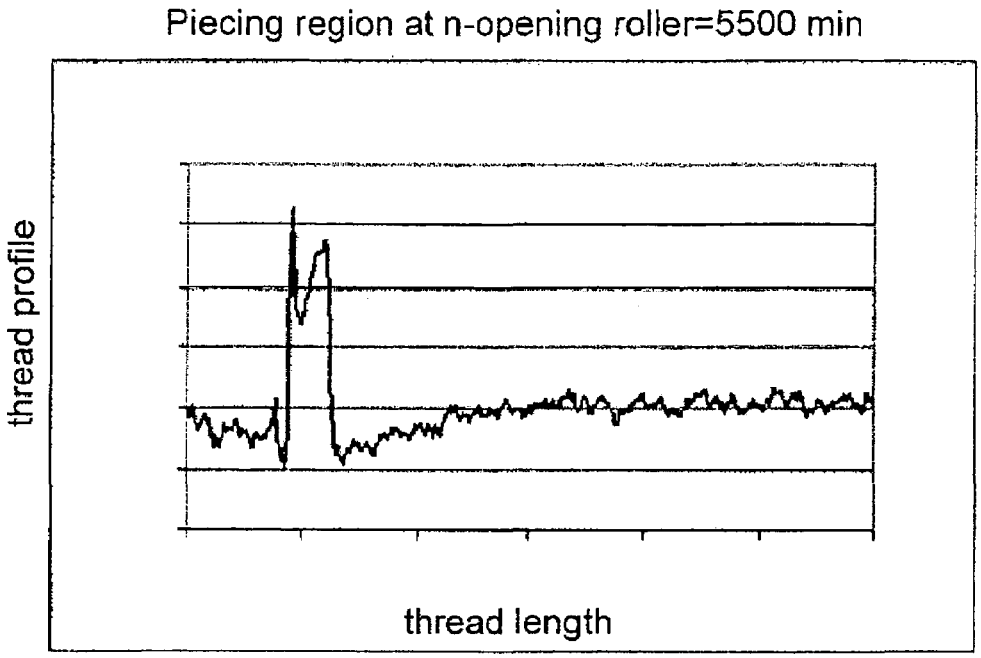
FIG. 2 shows the profile of a piecing at a piecing speed of the opening roller of 5,500 revolutions per minute.

Referring to FIG. 2, a graph of a thread profile in the piecing region is shown, which is produced at a piecing speed of the opening roller 12 of about 5,500 $min^{-1}$. It can clearly be seen here how a thin point is formed after the piecing after the piecing process. This deviation from the thread profile is only adjusted in the further course over the thread length to the desired thread profile when the open end spinning device 1 has reached its operating state after the piecing process; in other words, when, inter alia, the opening roller 12 and the spinning rotor 2 are driven at their respective operating speeds.

Figure 3:
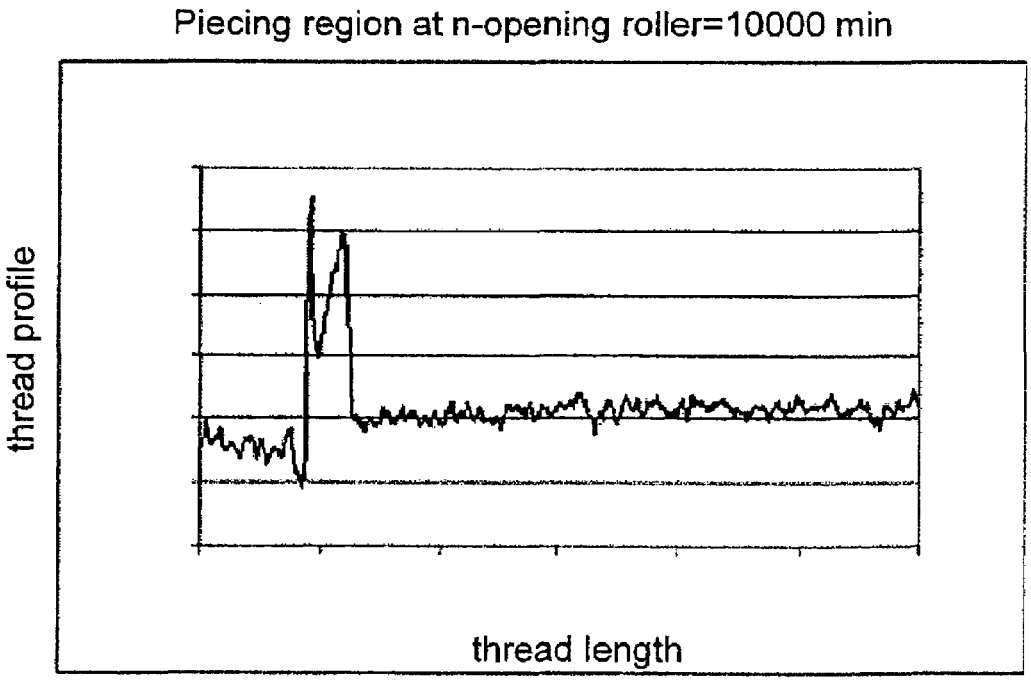
FIG. 3 shows the profile of a piecing at a piecing speed of the opening roller of 10,000 revolutions per minute.

In contrast to this, FIG. 3 shows a thread profile in the piecing region, which is produced at a piecing speed of the opening roller 12 of about 10,000 $min^{-1}$. Directly after the piecing, a thread profile is formed, which virtually corresponds to the thread profile, which is achieved during the spinning process. This is to be attributed to the increase in the fiber quantity provided, which is achieved by the increased piecing speed of the opening roller 12.

In order to maintain the equality of the thread which is virtually achieved, the piecing speed of the opening roller 12 is only reduced after the complete working off of the drawing in accumulation to the optimal operating speed of the opening roller 12 required for spinning operation.

These advantages are only achieved by increasing the piecing speed, with the other spinning and piecing parameters remaining unchanged. The increase in the piecing speed of the opening roller 12 consequently leads, in the piecing region, to an effective combing out of the fibers.

What is claimed is:

1. Method for operating an open end spinning device (1), comprising a spinning rotor (2) and an opening roller (12), which can be driven individually, controlled independently of one another, wherein after an interruption of the spinning process has taken place as a result of the detection of the absence of a thread, a piecing process is introduced, comprising a piecing up process, in which an upper thread passes through a fiber ring formed in the spinning rotor (2) and is connected thereto, as well as a subsequent drawing in accumulation, which is used to reduce a thin point in the thread following the piecing, characterized in that during the piecing process, the opening roller (12) is temporarily driven at a piecing speed, which is above the operating speed of the opening roller (12).

2. Method according to claim 1, characterized in that the piecing speed of the opening roller (12) is reached prior to the beginning of the piecing process.

3. Method according to either of claims 1 or 2, characterized in that the piecing speed of the opening roller (12) is maintained during the complete working off of the drawing in accumulation.

4. Method according to claim 3, characterized in that the speed control of the opening roller (12) during the piecing process and the process of the drawing in accumulation take place independently of other parameters influencing these processes, by means of a control mechanism (21).

5. Method according to claim 1, characterized in that the piecing speed is between 10% and 40% above the operating speed of the opening roller (12).

* * * * *